US006384356B1

(12) United States Patent
Postmus et al.

(10) Patent No.: US 6,384,356 B1
(45) Date of Patent: May 7, 2002

(54) SWITCH WITH SNAP-ACTION CLOSURE

(75) Inventors: Albert Jozef Peter Postmus, Goor; Soedjiemat Fransesco Darmohoetomo, Halle, both of (NL)

(73) Assignee: Holec Holland N.V., Hengelo (NL)

( * ) Notice: Subject to any disclaimer, the term of this patent is extended or adjusted under 35 U.S.C. 154(b) by 0 days.

(21) Appl. No.: 09/647,167

(22) PCT Filed: Mar. 24, 1999

(86) PCT No.: PCT/NL99/00162

§ 371 Date: Sep. 27, 2000

§ 102(e) Date: Sep. 27, 2000

(87) PCT Pub. No.: WO99/50864

PCT Pub. Date: Oct. 7, 1999

(30) Foreign Application Priority Data

Mar. 27, 1998 (NL) ..... 1008731

(51) Int. Cl.[7] ..... H01H 9/20
(52) U.S. Cl. ..... 200/402; 200/318; 200/324
(58) Field of Search ..... 200/400, 402, 200/424–431, 468–471, 318–325

(56) References Cited

U.S. PATENT DOCUMENTS 4,260,865 A * 4/1981 Horiuchi ..... 200/320
4,687,791 A * 8/1987 Bartolo et al. ..... 200/153 G
4,687,891 A 8/1987 Bartolo et al. ..... 200/153.6
4,740,770 A 4/1988 Lazareth et al. ..... 335/171
5,140,117 A * 8/1992 Vianson ..... 200/400
5,326,950 A * 7/1994 Lammers et al. ..... 200/469

FOREIGN PATENT DOCUMENTS

| | | | |
|---|---|---|---|
| DE | 37 21 069 | 8/1988 | ..... H01H/3/30 |
| DE | 39 36 610 | 5/1991 | ..... H01H/3/46 |
| FR | 2 552 930 | 4/1985 | ..... H01H/71/10 |
| WO | WO 95/29499 | 11/1995 | ..... H01H/71/50 |
| WO | WO 96/17368 | 6/1996 | ..... H01H/71/52 |

OTHER PUBLICATIONS

*AEI Engineering*, vol. 7, No. 2, 1967, p. 101.

* cited by examiner

*Primary Examiner*—Michael Friedhofer
(74) *Attorney, Agent, or Firm*—Young & Thompson

(57) ABSTRACT

A switch includes two interacting contacts (1, 2) and a closing spring (5, 11, 15, 21) for moving the contacts into the closed position, an operating button which can be used to initiate a prestressing phase of the closing spring (5, 11, 15, 21), and a locking device (6) for locking the contacts (1, 2) until a predetermined moment at which the influence of the prestressed closing spring (5, 11, 15, 21) is to be released onto the contacts. The locking device (6) is designated to lock the interacting contacts (1, 2), during the prestressing phase, at a contact distance. The contact distance to be locked being less than the contact distance in the open position of the contacts (1, 2).

8 Claims, 2 Drawing Sheets

SWITCH WITH SNAP-ACTION CLOSURE

BACKGROUND OF THE INVENTION

The invention relates to a switch comprising at least two interacting contacts, a closing spring for moving the contacts into the closed position, an operating button which can be used to initiate a prestressing phase of the closing spring, and a locking device for locking the contacts, in closing the switch, until a predetermined moment at which the influence of the prestressed closing spring is to be released onto the contacts.

A switch of this nature is known from international patent application WO 96/17368.

This known switch has two interacting contacts, namely a fixed contact and a movable contact which is attached to a switch shaft by means of a contact arm. This switch shaft is rotated by means of a prestressed closing spring in order to move the said contacts into the closed position. To this end, the closing spring is firstly prestressed by rotating the actuating button. In this process, a catch is used, comprising the movement of a knee device beyond the dead centre. The result is a snap action in which the spring is fully prestressed before the contacts are released. The closing spring also takes care of the contact force. In switches of this nature, the aim is to design them in such a manner that the switch can be closed in an operator-independent manner, i.e. that the contact pressure and the closing speed are as far as possible independent of the person operating the switch. This characteristic is important since it is necessary to prevent the contacts in a switch being damaged, on the one hand by being closed too quickly, in which event the contacts may be burnt away as a result of bouncing, and on the other hand by being closed too slowly, in which case the contact pressure is built up too slowly, so that contacts may become welded in place.

The known switch is also provided with a locking device for locking the contacts, beyond the theoretical turn-over point of the catch, in order to ensure that the closing spring is sufficiently prestressed. However, the problem remains that, particularly when using butt contacts, the risk of the contacts bouncing remains high, and consequently the contacts are burnt away and welded in place when a short circuit is closed.

In U.S. Pat. No. 4,687,891 as with of the above kind is described, in which the locking device is designed to lock the interacting contacts, during the prestressing phase, at a contact distance, the contact distance to be locked being less than the contact distance in the open position of the contacts.

SUMMARY OF THE INVENTION

The object of the invention is to provide a switch of the type mentioned in the preamble in which the abovementioned problems are avoided.

According to a first aspect of the invention, this object is achieved by the fact that on that side of the contact arm of the movable contact which is remote from the fixed contact there is a control lever which can pivot at a point between its ends and, at one end, adjoins the contact arm, the profile of this end being such that, by rotating this lever under the influence of the prestressed closing spring, the movable contacts can be moved into contact with the fixed contact, and in that the locking device comprises a releasable securing element which, in the prestressing phase of the closing spring, secures the control lever in a position in which the movable contact lies at the contact distance which is to be locked from the fixed contact.

According to a second aspect of the invention the above object is achieved by the fact that on that side of the contact arm (3) of the movable contact (2) which is remote from the fixed contact, there is a first lever (16) which can pivot about a point (17) between its ends and one end of which is directed towards the contact arm (3) and is pivotably (19) connected to an end of a second lever (18), the other end of which is pivotably connected to the contact arm (3), and in that the locking device comprises a releasable securing element (20) which, in the prestressing phase of the closing spring (5, 21), secures the first lever (16) in a position in which the movable contact lies at the contact distance which is to be locked from the fixed contact (1).

As a result, the contacts are moved towards one another during the stressing of the closing/contact-force spring as far as a distance which is selected to be such that there is no possibility of any spark-over between the contacts. After the closing/contact-force spring has been sufficiently prestressed, the effect of the closing/contact-force spring is released onto the contacts. Compared to the conventional way of closing the switch, only a small fraction of the spring energy which is built up will be converted into kinetic energy from the closing/contact-force spring system to the contacts. Using the invention considerably reduces the risk of bouncing and also of the contacts experiencing welding phenomena.

It should be noted that a blocking device for preventing the switch shaft from bouncing back out of the open position, i.e. towards the closed position, of the contacts is known per se from international patent application WO 95/29499. However, this device is used to suppress bouncing phenomena when the switch is opened.

The locking device of the switch of U.S. Pat. No. 4,687,891 is provided between prestressing spring and contact arm. In contrast the locking device of the switch of present invention is located separately. Thereby a higher power can be switched, which is not possible with the switch known from U.S. Pat. No. 4,687,891.

DESCRIPTION OF THE PREFERRED EMBODIMENTS

Figure 1:
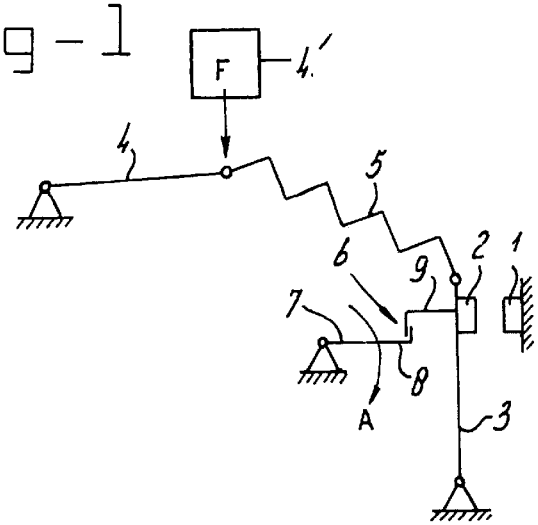
FIG. 1 is a schematic illustration of a first embodiment of the present invention.

The invention will be explained in more detail below with reference to the drawings, in which FIGS. 1–6 diagrammatically depict embodiments of the invention.

The switch comprises a set of contacts, of which only two interacting contacts, comprising the fixed contact 1 and the movable contact 2, are shown in the embodiments illustrated in FIGS. 1–6. The movable contact 2 is attached to a contact arm 3. The closing drive for the movable contact 2 is formed by a knee, which comprises the lever 4 and the closing/contact-force spring 5. Said knee acts on the contact arm 3 of the movable contact 2. The switch furthermore comprises a locking device 6 for locking the contacts so that they cannot readily close from the open position.

The switch shown in the figures is depicted in the open position. The opening spring is not shown in FIG. 1.

When the switch is to be closed, an actuating button 4' is used to exert a force F in the direction of the arrow on the knee of the knee device comprising the knee lever 4 and the closing spring 5. The actuating button and the link between the actuating button and the knee of the knee device is not shown for the sake of clarity, but is obviously easy for a person skilled in the art to design. When the force F is exerted on the knee of the knee device 4, 5, the free end of the contact arm 3, and therefore the contact 2, is moved to the right towards the fixed contact 1. The closing force F initiates and continues a prestressing phase of the closing/contact-force spring. In this prestressing phase, after an initial period, the movable contact 2 is locked by means of the locking device 6. At the end of this initial period, the movable contact 2 has been moved to a distance from the fixed contact 1 which is such that there is no possibility of spark-over between the contacts. The movable contact 2 is held at this contact distance which is to be locked, which distance is less than the contact distance in the open position of the contacts. After this initial period, the closing/contact-force spring is prestressed further until it has reached a level of prestress which is sufficient to close the two contacts 1, 2. As soon as this level is reached, the locking device 6 is released.

It should be noted that in the initial period of the prestressing phase the movable contact is moved to the said shorter contact distance, which is to be locked, from the associated fixed contact by the closing spring being stressed by means of the force F while the movable contact 2 is not yet locked. However, it is quite conceivable for this shorter contact distance to be brought about in some other, for example mechanical, way.

In the embodiment shown in FIG. 1, the locking device 6 comprises a securing element 7 which, in the prestressing phase of the closing spring 5, secures the movable contact 2 after the said shorter contact distance which is to be locked has been reached. Obviously, various securing elements are possible, and it is conceivable, for example, for a pawl device to be present on the other side of the contact arm 3, which device locks the movable contact, for example by the contact arm 3 butting against a pawl (not shown) which, when it is rotated away, can release the contact arm 3.

The securing element shown in FIG. 1 is in the form of a grip lever which is pivotably attached at one end. By means of a prestressing spring (not shown), this grip lever 7 is prestressed in the position shown. The free end of the grip lever 7 is provided with a hook 8 which, in the open position of the contacts 1, 2, engages behind a hook 9 which is attached to the contact arm 3 of the movable contact 2. In the open position of the switch shown in FIG. 1, the mutually facing grip faces of the hooks 8, 9 lie at a distance from one another which is equal to the contact distance in the open position less the contact distance which is to be locked.

When, after the initial period of the prestressing phase of the closing/contact-force spring 5, the said spring has been sufficiently prestressed, the grip lever 7 is pivoted in the direction of the arrow A, counter to the force of its prestressing spring, with the result that the hook 8 and, with it, the contact arm 3 and the associated movable contact 2 are released. The released contact 2 will make contact with the fixed contact 1 in an operator-independent manner and with the minimum possible risk of bouncing.

It should be noted that the rotation of the grip lever 7 in the direction A can be produced, in a manner not shown, by the actuating button (likewise not shown) of the switch.

Furthermore, it is clear that the grip lever and/or the fixed hook 8 are attached in such a manner that, when the contact arm 3 moves from the closed position into the open position of the contacts, they automatically slide over one another until the position shown in FIG. 1 is reached.

Figure 2:
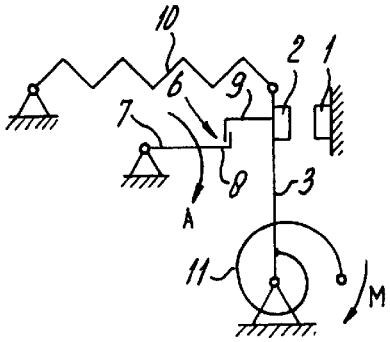
FIG. 2 is a schematic illustration of a second embodiment of the present invention.

The switch in the embodiment shown in FIG. 2 comprises the fixed contact 1, the movable contact 2 with the contact arm 3, and the locking device 7, 8, 9, as in the embodiment shown in FIG. 1. For this reason, these components will not be described.

This figure also shows the opening spring 10.

In the embodiment shown in FIG. 2, the movable contact 2 is driven, via the contact arm 3, by a coil spring 11. The coil spring 11 is prestressed by a moment M which can be derived, in a simple manner which will be standard procedure for a person skilled in the art, from the actuating button (not shown) of the switch.

The said moment will move the movable contact 2 towards the fixed contact 1, so that this movement is locked by grip lever 7. After the closing spring has been sufficiently prestressed, the movable contact 2 is released by grip lever 7 being rotated in the direction of the arrow A, and the contacts will close in an operator-independent, bounce-free manner.

Figure 3:
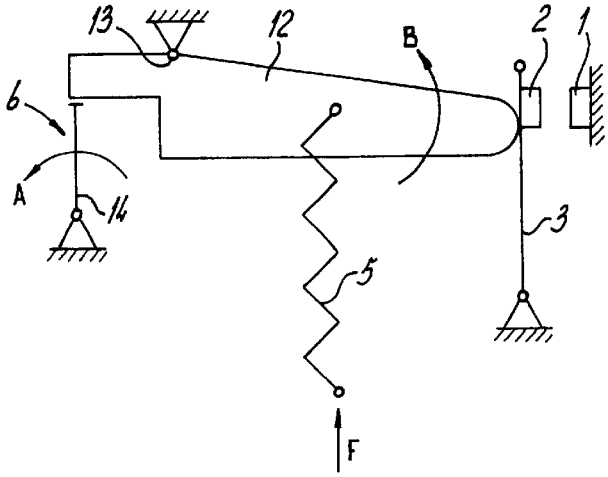
FIG. 3 is a schematic illustration of a third embodiment of the present invention.

In the switch shown in FIG. 3, the movable contact 2 is driven by means of a control lever 12 which is pivotable at a point 13. One end of the control lever 12 interacts with the contact arm 3. This particular end has a profile which is such that, through the rotation of this control lever 12, the contact arm 3, and therefore the contact 2, is moved towards the fixed contact 2. Here too, a prestressed closing spring 5 is present. The control lever 12 is locked by means of the locking device 6 which, in this embodiment, comprises a releasable securing element 14. In the prestressing phase of the closing spring 5, this securing element 14 secures the control lever 12 in a position in which the movable contact 2 lies at the contact distance which is to be locked from the fixed contact 1.

To close the switch, the closing spring 5 is prestressed by means of a force F which is derived from the movement of the actuating button of the switch. In the initial period of the prestressing phase of the closing spring 5, the control lever 12 is rotated in the direction of the arrow B and, by means of the profile of that end of the control lever 12 which bears against the contact arm 3, the movable contact 2 is moved a short distance to the right, until the contact distance is equal to the abovementioned contact distance which is to be locked. As soon as this contact distance is reached, the control lever 12 is secured by means of the securing element 14, which in this embodiment is designed as a pivotable pawl 14. In the remaining part of the prestressing phase, the closing spring 5 is prestressed further until it has reached a predetermined level of prestress, after which the securing element 14 is rotated in the direction of the arrow A. This rotation can be derived from the movement of the actuating button (not shown) of the switch. It should furthermore be noted that the securing element 14 is prestressed in the position shown in FIG. 3.

In the open position of the switch, the distance between the free end of the securing element 14 and the opposite face of the control lever 12 is equal to the contact distance in the open position less the contact distance which is to be locked.

It should be noted that the pawl 14 of the locking device can also interact with the top face of the right-hand section of the control lever 12.

Figure 4:
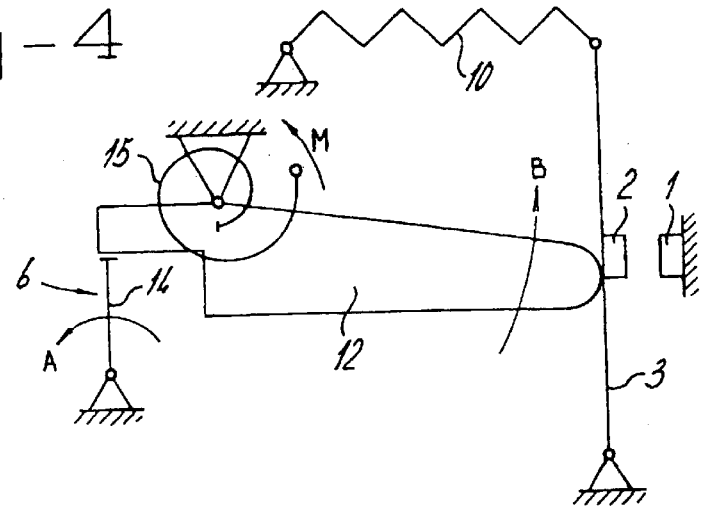
FIG. 4 is a schematic illustration of a fourth embodiment of the present invention.

In the embodiment of the switch according to the invention shown in FIG. 4, the opening spring 10 is also illustrated. In this embodiment, the control lever 12 is driven by the coil spring 15. By means of a moment M, which can be derived from the actuating button, acting on the closing spring 3, the control lever 12 is rotated in the direction of the arrow B, with the result that the contacts 1, 2 are moved towards one another. The movement of the contact arm 3 is terminated temporarily by the securing element 14 or pawl securing the control lever 12. The position of the contact arm 3, and therefore of the movable contact 2, is maintained, while the coil spring 15 is prestressed further. At the moment when the coil spring 15 has been sufficiently prestressed, the securing element 14 is rotated in the direction of the arrow A, which rotation may, if appropriate, be derived from the movement of the actuating button of the switch. As a result, the control lever 12 is released and, under the influence of the prestressed coil spring 15, the contacts 1, 2 will close in an operator-independent manner and with the minimum possible risk of bouncing.

Figure 5:
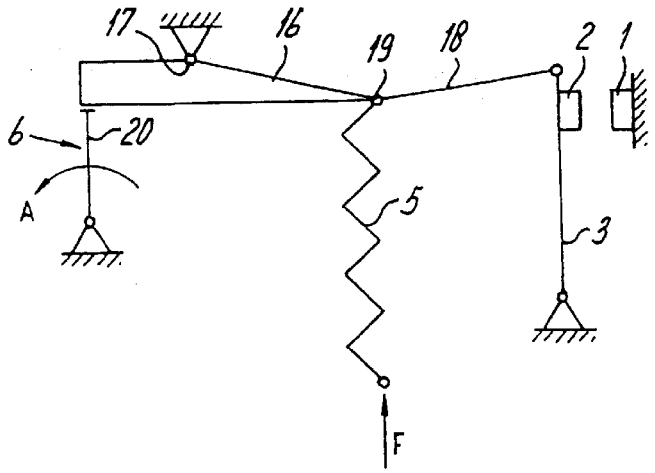
FIG. 5 is a schematic illustration of a fifth embodiment of the present invention.
Figure 6:
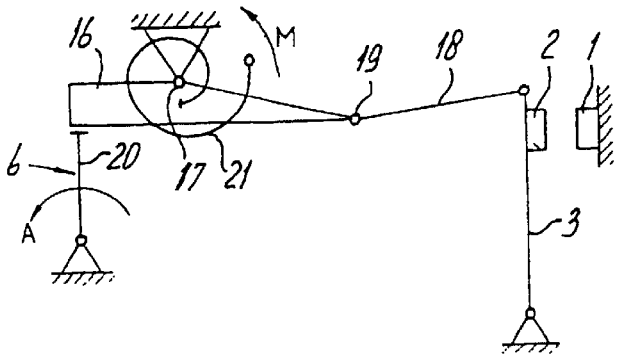
FIG. 6 is a schematic illustration of a sixth embodiment of the present invention.

In the embodiments shown in FIGS. 5 and 6, the movable contact 2, in particular contact arm 3, is driven by a set of levers which comprises a first lever 16 which can pivot about a point 17. The right-hand end of the first lever 16 is pivotably connected to one end of a second lever 18. The other end of the second lever 18 is pivotably connected to the contact arm 3. The locking device 6 in this case comprises the releasable securing element 20, which is in the form of a pivotable pawl.

In the embodiment shown in FIG. 5, the two contacts, comprising the fixed contact 1 and the movable contact 2, are driven by the closing spring 5 which has been prestressed by means of a force F. The closing spring 5 acts on the knee between the two levers 16 and 18. Obviously, the spring may act on a different location on the set of levers, provided that the prestressing force acts in the correct direction.

By exerting the force F, the first lever 16 will be rotated in such a manner that, by means of the second lever 18, the contact arm 3, and therefore the movable contact 2, will move towards the fixed contact 1, until this movement is temporarily interrupted by the securing element 20. As soon as the closing spring 5 has been sufficiently prestressed, the securing element 20 is rotated in the direction of the arrow A, so that the first lever 16 is released and the prestressed spring 5, via the system of levers 16, 18, will drive the contact arm 3, and therefore the contact 2, towards the fixed contact, and the contacts will close in an operator-independent manner and with the minimum possible risk of bouncing.

In the embodiment shown in FIG. 6, the coil spring 21 is used as the closing spring. This closing spring 21 is prestressed by a moment M which can be derived from the actuating button. By means of the moment M, the first lever 16, via the closing spring 21, will be rotated in such a manner that, by means of the second lever 18, the contact arm 3, and therefore the movable contact 2, are moved towards the fixed contact 7 until this movement is again terminated temporarily by the securing element 20. As soon as the coil spring 21 is sufficiently prestressed, the first lever 16 is released, by the securing element 20 being rotated in the direction of the arrow A. As a result of this first lever 16 being released, the contacts 1, 2 will, under the influence of the prestress in the coil spring 21, via the second lever 18 and the contact arm 3, close in an operator-independent manner and with the minimum possible risk of bouncing.

It should further be noted that the securing element or the pawl 21 can also interact, to the right of the pivot point 12, with the first or second lever, or even at the location of the connection. In the latter case, the pawl has to be pulled away in order to release the set of levers.

What is claimed is:

1. A switch, comprising:

at least a fixed contact (1) and a movable contact (2) interacting with each other, the movable contact having a contact arm;

a closing spring (5, 11, 15, 21) for moving the contacts into a closed position;

an operating button which can be used to initiate a prestressing phase of the closing spring (5, 11, 15, 21);

a locking device (6) for locking the contacts (1, 2), in closing the switch, until a predetermined moment at which an influence of the prestressed closing spring (5, 11, 15, 21) is to be released onto the contacts, wherein the locking device (6) is designed to lock the interacting contacts (1, 2), during the prestressing phase, at a contact distance to be locked that is less than a contact distance in an open position of the contacts (1, 2);

a control lever (12) on a side of the contact arm (3) of the movable contact (2) which is remote from the fixed contact (1), said control lever pivots at a pivot point (13), said control lever having one end that adjoins the contact arm (3), the profile of the one end being such that, by rotating said control lever under the influence of the prestressed closing spring, the movable contact (2) can be moved into contact with the fixed contact (1); and the locking device (6) having a releasable securing element (14) which, in the prestressing phase of the closing spring (5, 15), secures the control lever (12) in a position in which the movable contact (2) lies at the contact distance to be locked from the fixed contact (1).

2. The switch according to claim 1, wherein the securing element (14) comprises a pivotable pawl (14), a free end of said pawl faces towards the control lever (12), said pawl being disposed in such a manner that, in the prestressing phase, said pawl locks the control lever, while in the open position of the contacts (1, 2) mutually facing surfaces of the free end of the pawl and the control lever lie at a distance from one another which is equal to the contact distance in the open position of the contacts less the contact distance to be locked.

3. The switch according to claim 1, wherein the closing spring is a coil spring (15) that is arranged around the pivot point (13) of the control lever (12) and that has one end that acts on the control lever (12) and another end that is coupled to the operating button for prestressing the coil spring (15).

4. The switch according to claim 1, wherein the closing spring is one of a tension and a compression spring (15) acting on the control lever (12).

5. A switch, comprising:

at least a fixed contact (1) and a movable contact (2) interacting with each other, said movable contact having a contact arm;

a closing spring (5, 11, 15, 21) for moving the contacts into a closed position;

an operating button which can be used to initiate a prestressing phase of the closing spring (5, 11, 15, 21);

a locking device (6) for locking the contacts (1, 2), in closing the switch, until a predetermined moment at which an influence of the prestressed closing spring (5, 11, 15, 21) is to be released onto the contacts, wherein the locking device (6) is designed to lock the interacting contacts (1, 2), during the prestressing phase, at a contact distance to be locked that is less than a contact distance in an open position of the contacts (1, 2);

a first lever (16) on a side of the contact arm (3) of the movable contact (2) which is remote from the fixed contact, the first lever (16) pivoting about a pivot point (17), said first lever having one end which is directed towards the contact arm (3) and is pivotably (19) connected to one end of a second lever (18), another end of said second lever being pivotably connected to the contact arm (3);

the locking device comprising a releasable securing element (20) which, in the prestressing phase of the closing spring (5, 21), secures the first lever (16) in a position in which the movable contact lies at the contact distance to be locked from the fixed contact (1).

6. The switch according to claim 5, wherein the securing element (20) comprises a pivotable pawl (20), a free end of which is directed towards one of the first and second levers (16, 18), said pawl (20) being disposed in such a manner that said pawl locks the one of the first and second levers, while in the open position of the contacts (1, 2) mutually facing surfaces of the free end of the pawl and one of the levers (16, 18) lie at a distance from one another which is equal to the contact distance in the open position of the contacts (1, 2) less the contact distance to be locked.

7. The switch according to claim 5, wherein the closing spring is a coil spring (21) that is arranged around the pivot point (17) of the first lever (16) and that has one end that acts on the first lever (16) and another end that is coupled to the operating button for prestressing the coil spring (21).

8. The switch according to claim 5, wherein the closing spring is one of a tension and a compression spring (5) which acts on the one of the first or second levers (16, 18).

* * * * *